US005219075A

United States Patent [19]

White

[11] Patent Number: 5,219,075

[45] Date of Patent: Jun. 15, 1993

[54] TEMPERATURE AND HUMIDITY BUFFERING MUSICAL INSTRUMENT CASE COVER

[76] Inventor: Earle White, 14095 Christopher Robin Way, Grass Valley, Calif. 95945

[21] Appl. No.: 763,952

[22] Filed: Sep. 23, 1991

[51] Int. Cl.[5] ..... A45C 11/00

[52] U.S. Cl. ..... 206/314; 206/14; 206/523; 150/162; 190/124; 190/125

[58] Field of Search ..... 206/14, 314, 523; 150/162; 220/400, 403, 408, 437, 450, 464, 468, 469; 190/110, 111, 124, 125, 127; 229/3.5 MF; 5/653; 2/81; 428/263, 285, 920

[56] References Cited

U.S. PATENT DOCUMENTS

| | | | |
|---|---|---|---|
| 1,986,393 | 1/1935 | Geib | 150/52 |
| 2,627,887 | 2/1953 | Becker | 150/52 |
| 3,048,262 | 8/1962 | Pascucci | 206/314 |
| 3,126,077 | 3/1964 | Marshall | 190/125 |
| 3,138,517 | 6/1964 | Charbonneau | 428/263 |
| 3,295,643 | 1/1967 | Peterson et al. | 190/125 |
| 3,410,443 | 11/1963 | Hofmann | 220/450 |
| 3,638,255 | 2/1972 | Sterrett | 5/653 |
| 3,770,122 | 11/1973 | Thiele | 229/2.5 MF |
| 3,901,384 | 8/1975 | Lee et al. | 206/314 |
| 3,938,569 | 2/1976 | Hill | 206/523 |
| 3,987,507 | 10/1976 | Hall | 5/653 |
| 4,054,710 | 10/1977 | Botsolas | 428/285 |
| 4,215,778 | 8/1980 | Kovins | 206/314 |
| 4,446,900 | 5/1984 | Markovich | 206/523 |
| 4,531,632 | 7/1985 | Weber | 206/314 |
| 4,685,155 | 8/1987 | Fingerhut et al. | 2/81 |
| 4,705,717 | 11/1987 | Cain et al. | 428/920 |
| 4,777,086 | 10/1988 | Madden et al. | 428/920 |
| 4,795,030 | 1/1989 | Boyce | 206/314 |
| 4,846,340 | 7/1989 | Walther | 206/14 |
| 4,871,597 | 10/1989 | Hobson | 428/920 |
| 4,927,705 | 5/1990 | Syme et al. | 428/285 |
| 5,022,554 | 6/1991 | Heeter et al. | 229/3.5 MF |
| 5,136,723 | 8/1992 | Aldridge et al. | 2/81 |

FOREIGN PATENT DOCUMENTS

| | | | |
|---|---|---|---|
| 1451468 | 9/1966 | France | 206/314 |
| 2169586 | 7/1986 | United Kingdom | 206/314 |

*Primary Examiner*—David T. Fidei
*Attorney, Agent, or Firm*—Joseph E. Gerber

[57] ABSTRACT

A musical instrument case cover is disclosed, the cover being comprised of flexible fabric top and bottom panels having a surrounding side panel of the same fabric therebetween. The side panel is longitudinally bisected over a portion of its length by a slide fastener. The fabric employed in the panels is comprised of a reflective outer portion made up of an outer clear polyester coating over a reflective metallic layer of aluminum. A sheet of woven strips of polyethylene backs the metallic layer which, in turn, is backed by a layer of resilient foam. A fabric lining is the innermost layer, the top and bottom panels having a thick layer of resilient foam between this lining and the reflective outer portion. Interior slide fasteners secure openings in the fabric lining through which the thick layer of foam may be removed and replaced.

24 Claims, 3 Drawing Sheets

FIG. - 1
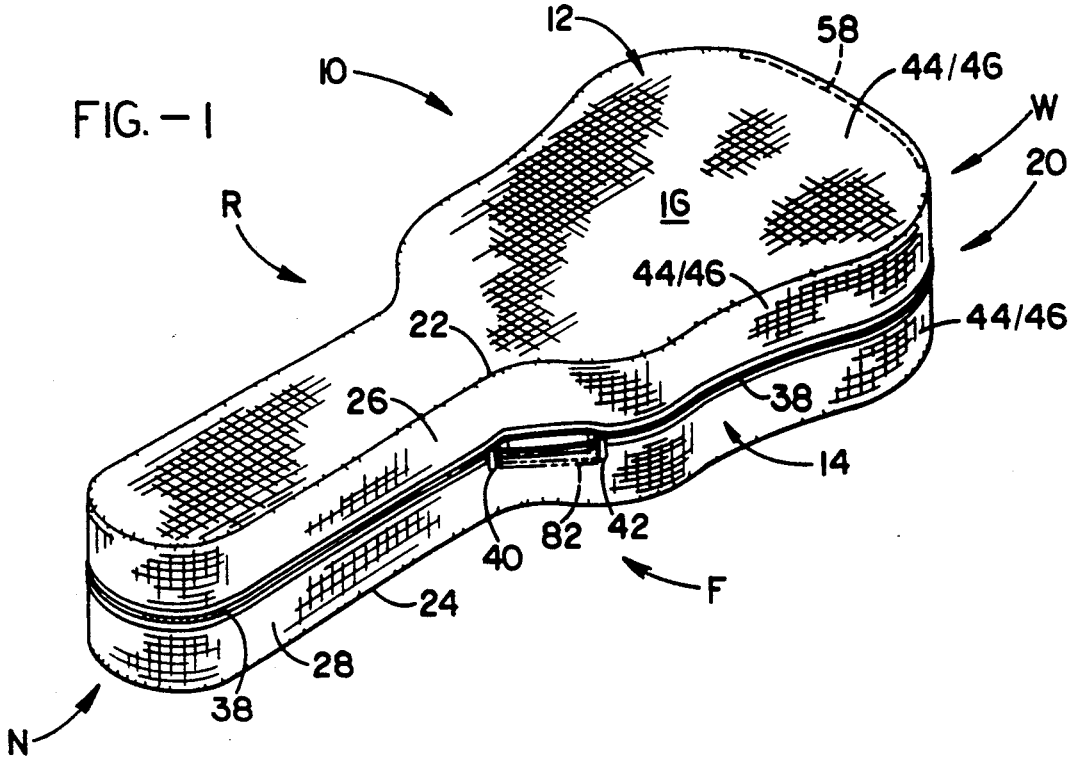
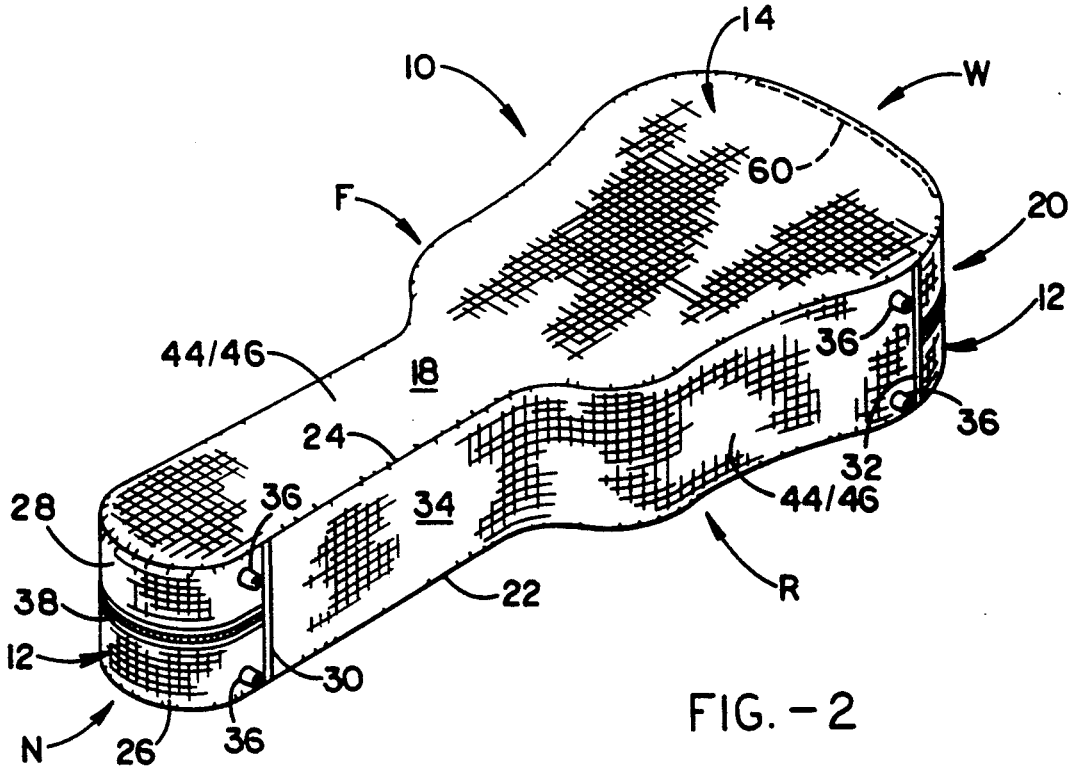
FIG. - 2

FIG.-3
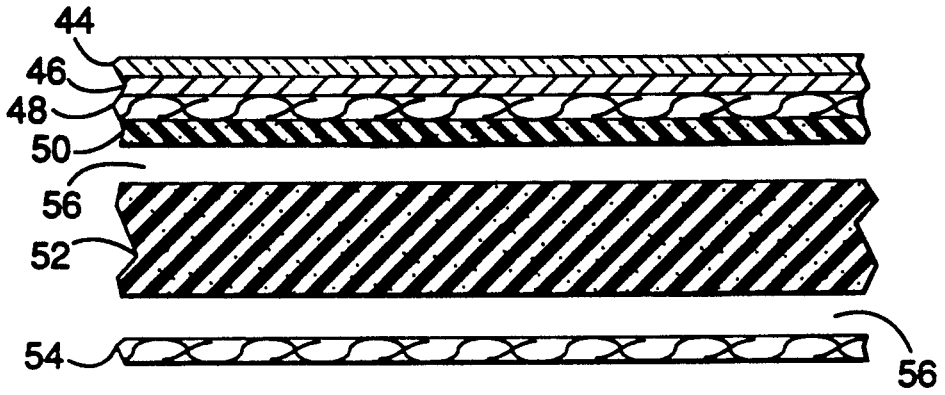
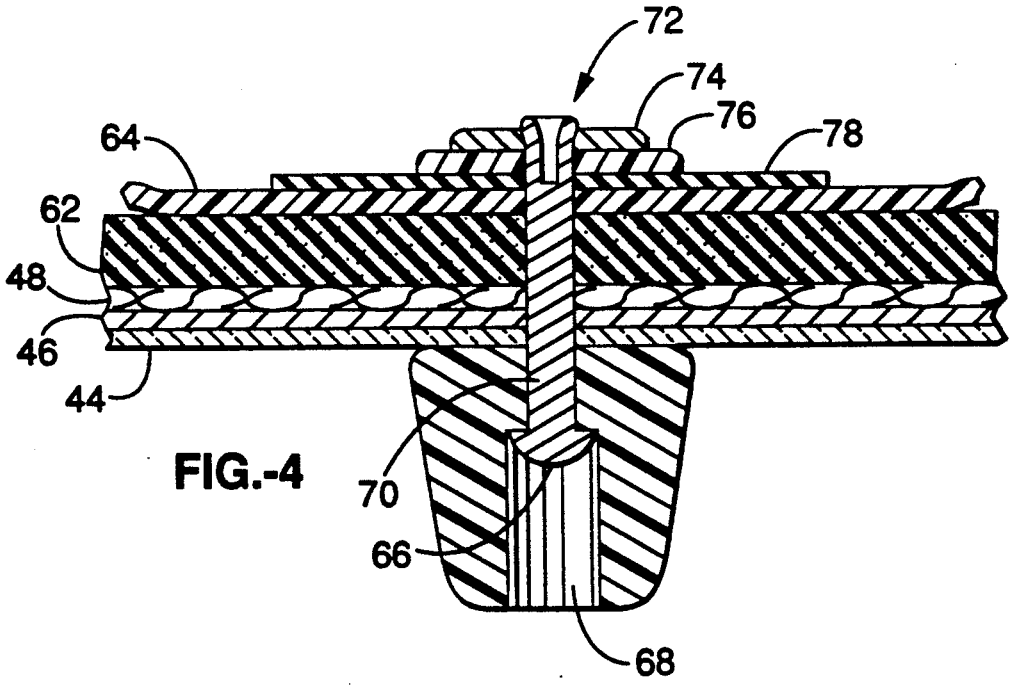
FIG.-4

TEMPERATURE AND HUMIDITY BUFFERING MUSICAL INSTRUMENT CASE COVER

BACKGROUND OF THE INVENTION

1. Field Of The Invention

The present invention relates generally to articles for containing, storing and transporting musical instruments, and more particularly to an auxiliary cover for use over a conventional musical instrument case.

2. Description Of The Related Art

Fine musical instruments are complex, delicate machines which, when not being played, must be protected from damage. Such protection is the purpose of a musical instrument's case. Using the example of a stringed instrument herein, specifically a guitar, a survey of commonly marketed guitar cases reveals that most are constructed of a plastic or reinforced cardboard composition protective shell, and a fabric lined interior that may or may not be contoured to support the guitar and otherwise to accommodate the guitar's shape. These conventional guitar cases are adapted primarily to protecting a guitar from scratches and mechanical shock.

A review of the patent literature yields examples of guitar cases directed to providing additional protection from shock. For example, see a guitar case with a resilient interior disclosed in U.S. Pat. No. 3,901,384 issued to Lee, et al. in 1975; and, a guitar case with an inflatable interior disclosed in U.S. Pat. No. 4,215,778 issued to Kovins in 1980. Other case constructions are directed to providing additional specific advantages. For example, see the collapsible guitar case disclosed in U.S. Pat. No. 1,986,393 issued to Geib in 1935; and, a case able to accommodate two guitars is disclosed in U.S. Pat. No. 4,795,030 issued to Boyce in 1989. And, fabric covers for protecting guitar cases from damage are also known, these commonly being constructed of woven and non-woven textiles. One example of such a cover is shown in a form specifically adapted for use in protecting a violin case in U.S. Pat. No. 2,627,887 issued to Becker in 1953.

However, none of the foregoing constructions are adapted to protecting such stringed musical instruments from two most insidious and destructive agents, these being temperature and humidity. Exposure to damaging temperatures of roughly 110° F. and above—especially prolonged exposure — creates a risk of damage to any glue joint under tension. Although creep temperatures reported in the product specifications of the hide and resin glues widely used in musical instrument construction are typically 40°-50° F. higher, failures typically occur between 110°-120° F.

Low humidity, as may be encountered in either high or low temperature environments, tends to reduce the moisture content of the wood in wooden instruments, making it prone to split—especially if the wood is under stress.

Fluctuations—especially rapid fluctuations—in temperature and humidity are also dangerous. Temperature changes tend to stress joints in a stringed instrument as its construction materials expand and contract. Changes in humidity do the same because wood tends to swell and shrink as its moisture content changes. Glue acts similarly. The more sudden these changes in temperature and humidity, the more these tendencies are exacerbated. In the worst cases, this expansion and contraction to cause an instrument may be damaged beyond repair.

Woodwind, brass and percussion instruments suffer similarly from the effects of rapid changes in temperature and humidity.

Conventional musical instrument cases, when moved from ambient indoor temperature and humidity into a hot or cold environment with low humidity, such as is frequently encountered in a vehicle interior, tend to equilibrate too quickly. One product known to be directed to humidity control within a musical instrument's case is commonly sold under the trademark "Godfather" and comprises a water-retentive, clay-based mass contained in a perforated canister. This product is used by soaking the mass in water and placing it in the canister which is, in turn, placed within an instrument's case to help regulate the humidity therein. However, inside a case wherein the temperature remains unregulated, humidity is only very roughly controlled.

Currently, the practice most often used in avoiding the effects of changing temperature and humidity on a musical instrument entails moving the instrument from the threatening environment to a more benign environment. This is generally labor intensive and causes musicians to carry cumbersome instruments along with them more frequently than would otherwise be necessary.

Thus, it appears that a long-felt, unsolved need exists for a device capable of minimizing the damaging effects of sudden changes in ambient temperature and humidity upon musical instruments. Such a device, most preferably, would be particularly adapted to the purpose of protecting an instrument from the extremely high and low temperatures, and extremely low humidity, it suffers during the most usual exposure times encountered at outdoor musical events, and during automobile and aircraft transport.

SUMMARY OF THE INVENTION

The temperature and humidity buffering musical instrument case cover of the present invention is adapted to overcome the above-noted shortcomings and to fulfill the stated needs. It comprises a highly reflective outer portion; an insulating inner portion beneath the outer portion; and, means for selectively opening and closing the cover. Means are also provided for removing and replacing the insulating inner portion of one or more of the panels of the cover.

Thus, it is an object of the present invention to provide an instrument case cover able to buffer sudden changes in ambient temperature and humidity, and thereby to reduce the deleterious effects thereof upon a musical instrument.

It is yet another object of the invention to provide an instrument case cover particularly adapted to the purpose of protecting an instrument from the extremely high and low temperatures, and extremely low humidity, it suffers during the most usual exposure times encountered at outdoor musical events, and during automobile and aircraft transport.

And, it is a further object of the present invention to provide an instrument case cover having insulation therein which may be removed and replaced with insulation of a different character.

Still further objects of the inventive musical instrument case cover disclosed herein will be apparent from the drawings and following detailed description thereof.

BRIEF DESCRIPTION OF THE DRAWINGS

FIG. 1 is a top front perspective front view of the musical instrument case cover of the present invention showing, in phantom, a handle of a guitar case within said cover protruding therefrom.

FIG. 2 is a bottom rear perspective view of the musical instrument case cover of FIG. 1.

FIG. 3 is an enlarged cross-sectional view through a primary panel of the inventive cover.

FIG. 4 is an enlarged cross-sectional view through the side panel and a foot of the inventive cover.

DESCRIPTION OF THE PREFERRED EMBODIMENT

Figure 5:
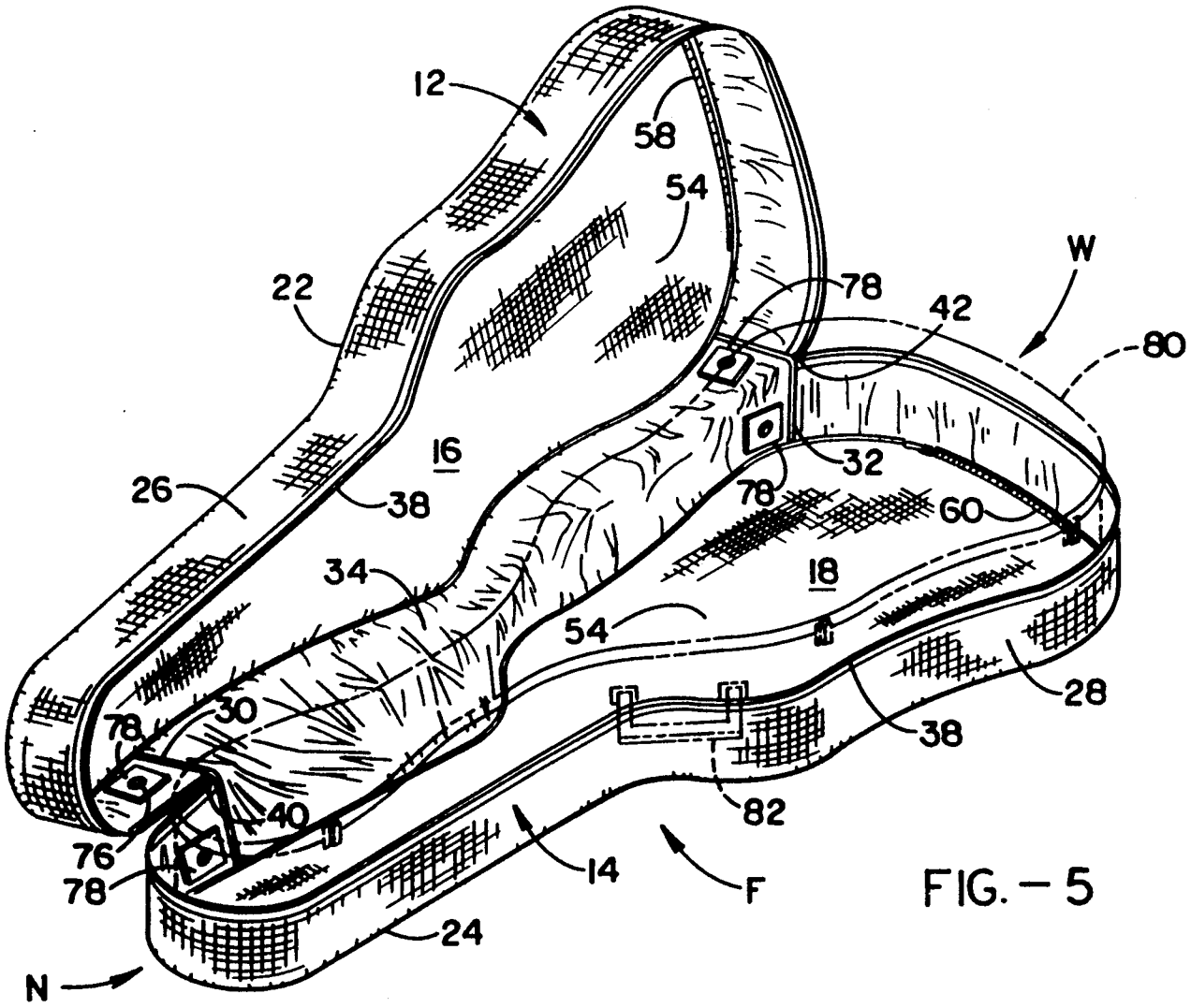
FIG. 5 is a top front perspective view of the inventive cover in an open orientation, showing a guitar case within the cover, in phantom.

Referring now specifically to the drawings, the inventive cover herein is generally identified with reference numeral 10. As is evident from the drawing figures, cover 10 is shaped and dimensioned so as to receive and cover substantially the entirety of a musical instrument case. Further, as seen best in FIGS. 1, 2 and especially FIG. 5, cover 10 is preferably comprised of top and bottom complementary shell portions numbered 12 and 14, respectively. Shells 12 and 14, in turn, each include a primary panel, the primary panel of top shell 12 being identified with reference numeral 16 and the primary panel of bottom shell 14 being identified with reference numeral 18. Panel 16 and 18 are generally planar, shaped to describe a conventional guitar case in plan view and constructed of a flexible fabric, the composition of which will be more fully discussed below.

Between top and bottom panels 16 and 18 a surrounding flexible fabric side panel 20, of the same below-described fabric, is defined. Side panel 20 has generally parallel side edges and is affixed, as by sewing, to the outer edges of top and bottom panels 16 and 18 at top and bottom seams 22 and 24, respectively. In the preferred embodiment, side panel 20 is longitudinally bisected over a substantial portion of its length into opposing upper and lower strips numbered 26 and 28, respectively. As is clear from comparison of FIGS. 1 and 2, strips 26 and 28 extend fully across cover 10's front F, and around its narrow end N as well as around its wide end W. Strips 26 and 28 terminate at seams 30 and 32 where they meet undivided rear panel 34 adjacent cover 10's narrow end N and wide end W, respectively. Rear panel 34 spans substantially the entire rear R of cover 10.

The preferred selective opening and closing means is slide fastener 38. Slide fastener 38 is disposed between strips 26 and 28, slide fastener 38 preferably including first and second opposing slide units numbered 40 and 42, respectively. When each slide unit is at rest at its respective end of travel adjacent rear panel 34, slide fastener 38 is maintained in an open orientation. Thus, in contrast, when slide units 40 and 42 are drawn toward a common point at the front F of cover 10, the portion of the slide fastener between each slide unit and the end of its travel adjacent rear panel 34 is closed. As will be explained below, a slide fastener commonly sold under the trademark Talon as a No. 8 zipper is preferred in practicing the present invention.

The rear R of cover 10 includes four feet 36 affixed thereto in such an orientation as to permit them to support cover 10 when resting in an upstanding position, i.e. when the rear R of cover 10 is adjacent a supporting surface such as a floor Feet 36 at cover 10's wide end W are disposed upon rear panel 34, while at cover 10's narrow end N, feet 36 are disposed on strips 26 and 28 with slide fastener 38 running therebetween. This placement of the narrow end feet on strips 26 and 28 tends to keep cover 10 most stable and at the highest possible point above a supporting surface while, at the same time, permitting slide fastener 38 to extend far enough to the rear R of cover 10 to permit it to be opened easily.

The flexible fabric used in the above-described construction is instrumental in providing the temperature and humidity buffering benefits of the invention. Broadly, it comprises a highly reflective outer portion and an insulating inner portion. In the preferred embodiment, the reflective outer portion is comprised of a three-layered sheet, the topmost layer of which may, in turn, comprise two separate layers itself. More specifically, as in FIG. 3 where the composition of top and bottom panels 16 and 18 is described, the outermost surface 44 is a clear coating of polyester, or the like, over a highly reflective metallic layer 46 such as aluminum. One skilled in the art of fashioning such surfaces may find it expedient to fuse two separate layers of film, to spray or otherwise apply one portion by deposition of finely divided particles or droplets over the other or to mix the two fractions and draw the mixture out into a single, integrated sheet. And, known products such as the one currently marketed under the trademark Mylar may also serve the purposes herein well.

Beneath metallic layer 46 is an inner facing, comprised first of a sheet of interwoven textile fabric strips 48. The textile fabric of interwoven sheet 48 is preferably polyethylene, this being comprised of opposing courses of strips at right angles to one another in a "basketweave" orientation, each strip (unnumbered) being of some 4 mm., or so, in width. Interwoven sheet 48 is bound as with adhesive, or the like (not shown) to metallic layer 46's underside, or inner face. Its purpose is to lend strength to the reflective outer portion of the cover.

The remaining component of the inner facing is a resilient backing sheet 50 comprised of closed-cell polyethylene foam, this being bound as with adhesive (not shown) to interwoven sheet 48. A thickness of roughly 1–2 mm. has been found satisfactory for backing sheet 50's purpose, this being to finish the inner surface of the reflective outer portion and to prevent disruption of the weave of interwoven sheet 48.

It should be noted that other durable highly reflective-finished fabrics may be substituted for the multiple-layered highly reflective outer portion just described, without departing from the spirit of the invention.

Beneath the highly reflective outer portion, but not attached thereto, is an insulating portion, this preferably being resilient and comprised of a thick (10 mm., or so) layer of closed-cell polyethylene foam 52. Insulating foam 52 serves a cushioning function as well as an insulating function. Of course, many other materials ranging from batting of cotton or other fibers to a full range of resilient foams, may serve this function well. If more shock protection is desired from cover 10, a stiffer, denser insulating material such as styrofoam, or other open or closed-cell foams may be substituted for insulating foam 52.

Insulating foam 52 is retained beneath layers 44–50, comprising the reflective outer portion, with a lining sheet 54 preferably comprised of a 210 denier oxford nylon fabric. Lining sheet 54 defines the innermost surface of top and bottom panels 16 and 18. Lining sheet 54 also lends some additional insulating and cushioning effects to these panels, supplementing the major contribution made by insulating foam 52. Of course, a great variety of fabrics may also work well for this purpose.

The layers of which top and bottom panels 16 and 18 are comprised are stitched together at seams 22 and 24 where they meet the parallel edges of side panel 20. However, insulating foam 52 is not stitched into these seams; it resides securely in a cavity 56 between overlying layers 44–50 of the reflective outer portion and underlying lining sheet 54 of each panel. Access to cavity 56 in each panel is provided through an opening in lining sheet 54, this opening being adjacent cover 10's wide end W. Interior slide fastener 58 secures the opening in top panel 16, and interior slide fastener 60 secures the opening in bottom panel 18.

The construction of side panel 20 is somewhat different in that a thick layer of insulating foam, such as foam 52 above, tends to interfere with the lay of the fabric as it is sculpted around the periphery of cover 10. Thus, as shown in FIG. 4, a slightly different construction is employed in side panel 20. Here, the reflective outer portion has some aspects very similar to those employed in the top and bottom panels. Specifically, the outermost surface 44 is a clear coating of polyester, or the like, over a highly reflective metallic layer 46 such as aluminum, just as above. And, an inner facing comprised first of a sheet of interwoven polyethylene textile fabric strips 48 bound, as with adhesive (not shown), is employed. Completing the facing, in contrast to the top and bottom panels, is a thicker (4 mm., or so) resilient backing sheet 62 comprised of closed-cell polyethylene foam. Backing sheet 62 is bound, as with adhesive (not shown), to interwoven sheet 48 of side panel 20. A lining sheet 64 is also provided, in this case, non-woven polypropylene having been used with success, and therefore being preferred. As above, lining sheet 64 and the reflective outer portion here comprised of layers 44–48, 62 and 64, are sewed into seams 22 and 24 where side panel 20 meets top and bottom panels 16 and 18. Around that portion of cover 10 where slide fastener 38 longitudinally bisects side panel 20, the remaining edges of said same layers are sewn to the tapes (unnumbered) of the slide fastener's opposing sides.

Mounting and construction of feet 36 are also shown in FIG. 4. Rivet head 66 is shown to be seated in foot 36's bore 68, its shaft 70 passing through an aperture (unnumbered) in the fabric of side wall 20. The rivet's spread end 72 retains first and second rigid washers 74 and 76 which, in turn, retain a reinforcing patch 78 which lays against lining sheet 64. Washers 74 and 76 may be of metal or plastic, or the like; and, patch 78 may be any flexible, durable material such as rubber, leather, vinyl, or the like.

In use, cover 10 is opened as in FIG. 5, and a hard shell instrument case 80 such as holds a guitar, or the like, is laid therein. Slide units 40 and 42 of slide fastener 38 are drawn toward a midpoint at cover 10's front to butt up against opposing sides of guitar case 80's handle 82. Handle 82 is permitted to project through the unfastened aperture that remains between slide units 40 and 42. Different guitar cases are easily accommodated as placement of the aperture through which a handle may project is inherently adjustable.

Some suggestion of the performance to be expected of the forgoing inventive cover may be gathered by review of the following examples.

EXAMPLE 1

| | EXAMPLE 1 | |
|---|---|---|
| | Temp. °F. | Relative Humid. % |
| Ambient conditions | 85° F. | 58% |
| Test conditions | 132° F. | 24% |
| After 3 hrs: | | |
| Std. guitar case | 132° F. | 26% |
| Case w/ Cover | 90° F. | 49% |

The trial for Example 1 was run using a dark blue automobile as the chamber for the test conditions. The standard guitar case control was left empty, i.e. without a musical instrument, and an identical empty test case having the inventive cover thereover was tested at the same time. Direct sunlight was not permitted to shine on either case. A combination thermometer-hygrometer accurate to 1° F. and 1% relative humidity was placed within both the control and the test case.

EXAMPLE 2

| | EXAMPLE 2 | |
|---|---|---|
| | Temp. °F. | Relative Humid. % |
| Ambient conditions | 72° F. | 50% |
| Test conditions | 30° F. | 24% |
| After 3 hrs: | | |
| Std. guitar case | 30° F. | 26% |
| Case w/ Cover | 63° F. | 44% |

The trial for Example 2 was run using a freezer as the chamber for the test conditions. Procedures as set forth in Example 1 were followed.

Note that the above examples should only taken as very rough approximations of the results likely to be achieved in using the inventive case cover. Different case and cover constructions may significantly alter outcomes, as may different test chambers. And, when a case contains a musical instrument such as a guitar, or the like, the instrument's own thermal mass is expected to have some slowing effect, itself, on the rate of equilibration over these tests conducted with empty cases. However, such a slowed reaction would seem to be beneficial in further protecting the instrument from damage. Indeed, in actual use, it is expected that an instrument will remain undamaged for up to five hours when moved from roughly room temperature and humidity to the extremes most commonly encountered in normal use, storage and transport of the instrument. In less extreme conditions, protection is likely to maintained for up to 24 hours, or perhaps longer.

The foregoing detailed disclosure of the inventive musical instrument case cover 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive case cover may later be realized. Accordingly, the scope of the invention should be determined with reference to the appended claims, and not by the examples which have herein been given.

I claim:

1. A musical instrument case cover, comprising:

a. a first primary panel and a second primary panel, each said panel being generally planar and comprised of a highly reflective outer portion including a metallic surface layer over an inner facing layer, wherein said inner facing layer is comprised of a sheet of interwoven textile fabric strips bound to said metallic surface layer's inner face, and a resilient backing sheet bound to said interwoven textile fabric sheet's inner face, each said primary panel further including an insulating inner portion comprised of a resilient insulating sheet retained beneath said outer portion by a lining sheet of textile fabric, said primary panels being oriented in generally parallel planes, with said lining sheet of said first primary panel opposing said lining sheet of said second primary panel, said second primary panel having a shape and dimensions similar to those of said first primary panel such that, when said primary panels are so opposingly oriented, an outer edge of said second primary panel follows an outer edge of said first primary panel, thereby to mirror the shape and dimensions of said first primary panel;

b. a surrounding side panel comprised of a highly reflective outer portion including a metallic surface layer over an inner facing layer, wherein said inner facing layer is comprised of a sheet of interwoven textile fabric strips bound to said metallic surface layer's inner face, and a resilient insulating backing sheet, bound to said interwoven textile fabric sheet's inner face, said side panel further including a lining sheet of textile fabric, said side panel having a pair of substantially continuous longitudinal edges, a first of said longitudinal edges affixed to said outer edge of said first primary panel and a second of said longitudinal edges being affixed to said outer edge of said second primary panel, said side panel thereby, along with said primary panels, defining a cavity therewithin having a shape and dimensions capable of containing a musical instrument case; and, c. means for selectively opening and closing said case cover, whereby a musical instrument case may be selectively deposited therewithin and removed therefrom.

2. The case cover of claim 1, wherein said side panel's resilient insulating backing sheet is approximately half as thick as said primary panels' resilient insulating sheets.

3. A musical instrument case cover, comprising:

a. a first primary panel and a second primary panel, each said panel being generally planar and comprised of a highly reflective outer portion including a metallic surface layer over an inner facing layer, wherein said inner facing layer is comprised of a sheet of interwoven textile fabric strips bound to said metallic surface layer's inner face, and a resilient backing sheet bound to said interwoven textile fabric sheet's inner face, each said primary panel further including an insulating inner portion comprised of a resilient insulating sheet retained beneath said outer portion by a lining sheet of textile fabric, said primary panels being oriented in generally parallel planes, with said lining sheet of said first primary panel opposing said lining sheet of said second primary panel, said second primary panel having a shape and dimensions similar to those of said first primary panel such that, when said primary panels are so opposingly oriented, an outer edge of said second primary panel follows an outer edge of said first primary panel, thereby to mirror the shape and dimensions of said first primary panel;

b. means included in at least one of said primary panels for permitting said resilient insulating sheet to be removed and replaced from between said lining sheet and said outer portion;

c. a surrounding side panel comprised of a highly reflective outer portion including a metallic surface layer over an inner facing layer, wherein said inner facing layer is comprised of a sheet of interwoven textile fabric strips bound to said metallic surface layer's inner face, and a resilient insulating sheet, bound to said interwoven textile fabric sheet's inner face, said side panel further including a lining sheet of textile fabric, said side panel having a pair of substantially continuous longitudinal edges, a first of said longitudinal edges being affixed to said outer edge of said first primary panel and a second of said longitudinal edges being affixed to said outer edge of said second primary panel, said side panel thereby, along with said primary panels, defining a cavity therewithin having a shape and dimensions capable of containing a musical instrument case; and, d. means for selectively opening and closing said case cover, whereby a musical instrument case may be selectively deposited therewithin and removed therefrom.

4. A musical instrument case cover comprising:

a. a highly reflective outer portion shaped and dimensioned so as to receive and cover substantially the entirety of a musical instrument case;

b. an insulating inner portion beneath said outer portion comprising a lining sheet of textile fabric and a layer of insulating material, said lining sheet retaining said insulating material between said lining sheet and said outer portion;

c. means in said lining sheet for permitting said insulating material to be removed and replaced from between said lining sheet and said outer portion, and;

d. means for selectively opening and closing said case cover, whereby a musical instrument case may be selectively deposited therewithin and removed therefrom.

5. The case cover of claim 4, wherein said case cover is shaped and dimensioned so as to receive and cover substantially the entirety of a guitar case.

6. The case cover of claim 4, wherein said case cover is comprised of top and bottom complementary shell portions, each said shell portion, in turn, being comprised of a said reflective outer portion and a said insulating inner portion.

7. The case cover of claim 4, wherein said case cover is comprised of first and second like-shaped primary panels, and a surrounding side panel, each said panel, in turn, being comprised of a said reflective outer portion and a said insulating inner portion, each said primary panel further including said means in its lining sheet for permitting said insulating material to be removed and replaced from between its lining sheet and outer portion, said side panel having a pair of substantially continuous longitudinal edges, a first of said longitudinal edges being bound to an outer edge of said first primary panel and a second of said longitudinal edges being bound to an outer edge of said second primary panel, said panels thereby defining a cavity therewithin having a shape and dimensions capable of containing a musical instrument case.

8. The case cover of claim 7, wherein said side panel is further comprised of opposing strips having said opening and closing means therebetween.

9. The case cover of claim 8, wherein said opening and closing means comprises a slide fastener.

10. The case cover of claim 7, wherein said side panel further includes a plurality of feet projecting therefrom.

11. The case cover of claim 4, wherein said case cover has a wide end and a narrow end.

12. The case cover of claim 4, wherein said opening and closing means comprises a slide fastener including a pair of opposing slide units.

13. The case cover of claim 4, wherein said means for permitting removal and replacement of said insulating material comprises a slide fastener.

14. The case cover of claim 4, wherein said means for permitting removal and replacement of said insulating material is disposed toward a wider end of said case cover.

15. A musical instrument case cover, comprising:

a. a first primary panel and a second primary panel, each said panel being generally planar and comprised of a highly reflective outer portion and an insulating inner portion, said primary panels being oriented in generally parallel planes with said insulating portion of said first primary panel opposing said insulating portion of said second primary panel, said second primary panel including an outer edge which, when said primary panels are so oriented, follows an outer edge of said first primary panel, thereby to mirror the shape and dimensions of said first primary panel;

b. a surrounding side panel comprised of opposing strips having a slide fastener therebetween for selectively opening and closing said cover, said side panel being further comprised of a highly reflective outer portion and an insulating inner portion, said side panel having a pair of substantially continuous longitudinal edges, a first of said longitudinal edges being bound to said outer edge of said first primary panel and a second of said longitudinal edges being bound to said outer edge of said second primary panel;

c. a slide fastener included in at least one of said primary panels for permitting insulating material to be removed from, and replaced in, said panel.

16. The case cover of claim 15, wherein said case cover has a wide end and a narrow end.

17. The case cover of claim 15, wherein said slide fastener permitting removal and replacement of said insulating material is disposed toward a wider end of said case cover.

18. A musical instrument case cover comprising:

a. top and bottom complementary shell portions, said shell portions being shaped and dimensioned so as to receive and cover substantially the entirety of a musical instrument case, each said shell portion being comprised of a highly reflective outer portion and an insulating inner portion, said insulating inner portion being comprised of a lining sheet of textile fabric and a layer of insulating material, said lining sheet retaining said insulating material between said lining sheet and said outer portion;

b. means in said lining sheet for permitting said insulating material to be removed and replaced from between said lining sheet and said outer portion, and;

c. means for selectively opening and closing said case cover, whereby a musical instrument case may be selectively deposited therewithin and removed therefrom.

19. The case cover of claim 18, wherein said case cover has a wide end and a narrow end.

20. The case cover of claim 18, wherein said means for permitting removal and replacement of said insulating material is disposed toward a wider end of said case cover.

21. The case cover of claim 18, wherein said case cover is shaped and dimensioned so as to receive and cover substantially the entirety of a guitar case.

22. The case cover of claim 18, wherein each said shell is comprised of a like-shaped primary panel and a surrounding strip, each said primary panel and strip, in turn, being comprised of a said reflective outer portion and a said insulating inner portion, each said primary panel further including said means in its lining sheet for permitting said insulating material to be removed and replaced from between its lining sheet and outer portion, each said strip having a pair of substantially continuous longitudinal edges, a first of each strip's longitudinal edges being bound to an outer edge of its respective primary panel, said strips' second longitudinal edges including said opening and closing means therebetween.

23. The case cover of claim 22, wherein said layer of insulating material of said strips is approximately half as thick as said layer of insulating material of said primary panels.

24. The case cover of claim 18, wherein said opening and closing means comprises a slide fastener including a pair of opposing slide units.

* * * * *